US005791947A

United States Patent [19]

Crane, Jr. et al.

[11] Patent Number: 5,791,947

[45] Date of Patent: Aug. 11, 1998

[54] CONTACT BEAM FOR ELECTRICAL INTERCONNECT COMPONENT

[75] Inventors: Stanford W. Crane, Jr.; Maria M. Portuondo, both of Boca Raton, Fla.

[73] Assignee: The Panda Project, Boca Raton, Fla.

[21] Appl. No.: 476,115

[22] Filed: Jun. 7, 1995

[51] Int. Cl.[6] ..... H01R 4/48

[52] U.S. Cl. ..... 439/862

[58] Field of Search ..... 439/861, 862, 439/857, 856, 636, 637, 660, 931

[56] References Cited

U.S. PATENT DOCUMENTS

| | | | |
|---|---|---|---|
| 3,585,573 | 6/1971 | Robshaw | 439/887 |
| 4,728,304 | 3/1988 | Fischer | 439/857 |
| 4,778,231 | 10/1988 | Seidler et al. | 439/857 |

FOREIGN PATENT DOCUMENTS

| | | |
|---|---|---|
| 2 286 523 | 4/1976 | France . |
| 2 681 985 | 4/1993 | France . |
| WO 94/13034 | 6/1994 | WIPO . |

OTHER PUBLICATIONS

Toute L'Electronique, "Optimisation des Connecteurs,"No. 507, Oct. 1985, pp. 36–39.

*Primary Examiner*—Gary F. Paumen
*Assistant Examiner*—Brian J. Biggi
*Attorney, Agent, or Firm*—Morgan, Lewis & Bockius LLP

[57] ABSTRACT

An electrically conductive contact beam for use in an electrical interconnect component. The contact beam includes a stabilizing section for securing the contact beam within a support substrate, and a contact section, connected to the stabilizing section, for establishing contact between the contact beam and an electrically conductive contact from another electrical interconnect component. The contact section includes a merge radius section connecting the contact section to the stabilizing section, a flexible section connected to the merge radius section and having an elongated curvature, a contact area, disposed at an end of the curvature opposite the merge radius section, for contacting the conductive contact from the other electrical interconnect component, and a lead-in section, connected to the contact area, for initiating deflection of the contact section upon contact of the lead-in section with a portion of the other electrical interconnect component.

20 Claims, 10 Drawing Sheets

CONTACT BEAM FOR ELECTRICAL INTERCONNECT COMPONENT

BACKGROUND OF THE INVENTION

1. Field of the Invention

The present invention relates to a plug-in electrical interconnect system and, in particular, to the configuration of electrical contacts used in the plug-in electrical interconnect system. Although the electrical contact configuration of the present invention is particularly suitable for use in connection with high-density systems, it may also be used with high-power systems or other systems.

2. Description of Related Technology

Electrical interconnect systems (including electronic interconnect systems) are used for interconnecting electrical and electronic systems and components. In general, electrical interconnect systems contain both a projection-type interconnect component, such as a conductive pin, and a receiving-type interconnect component, such as a conductive socket. In these types of electrical interconnect systems, electrical interconnection is accomplished by inserting the projection-type interconnect component into the receiving-type interconnect component. Such insertion brings the conductive portions of the projection-type and receiving-type interconnect components into contact with each other so that electrical signals may be transmitted through the interconnect components.

High-density electrical interconnect systems are characterized by the inclusion of a large number of interconnect component contacts within a small area. By definition, high-density electrical interconnect systems take up less space and include shorter signal paths than lower-density interconnect systems. The short signal paths associated with high-density interconnect systems allow such systems to transmit electrical signals at higher speeds. In general, the higher the contact density of an electrical interconnect system, the better.

A portion of a high-density electrical interconnect system conceived of by one of the inventors is depicted in FIG. 1. The electrical interconnect system of FIG. 1 includes a first insulative substrate 1, a plurality of projection-type electrical interconnect components (FIG. 1 only shows two of the projection-type interconnect components, and these are designated by the reference numerals 2*a* and 2*b*) secured to the first substrate, a second insulative substrate 3, and a plurality of receiving-type electrical interconnect components (FIG. 1 only shows two of the receiving-type components, and these are designated by the reference numerals 4*a* and 4*b*) secured to the second substrate.

Each of the electrical interconnect components 2*a*, 2*b*, 4*a*, 4*b* comprises multiple (e.g., four) isolated electrically conductive contacts. The contacts of the projection-type electrical interconnect components 2*a*, 2*b* are known as "posts," while the contacts of the receiving-type electrical interconnect components 4*a*, 4*b* are known as "beams." Reference numeral 2 in FIG. 1 is used to designate one of the posts and reference numeral 4 is used to designate one of the beams. In the configuration of FIG. 1, the posts 2 are placed around an insulative buttress 5 to provide insulation between the posts.

In operation, the projection-type interconnect components, 2*a*, 2*b* and the receiving-type interconnect components 4*a*, 4*b* are moved toward one another until the beams 4 of each receiving-type interconnect component contact and are spread apart by a corresponding one of the buttresses 5. Further movement of the projection-type and receiving-type interconnect components toward one another causes further spreading of the beams 4, until each projection-type interconnect component 2*a*, 2*b* is fully received within its corresponding receiving-type interconnect component 4*a*, 4*b*, respectively, in the manner depicted in FIG. 2.

When each projection-type receiving component 2*a*, 2*b* is received within its corresponding receiving-type interconnect component 4*a*, 4*b*, the projection-type and the receiving-type interconnect components are said to be mated. The mating of a projection-type interconnect component (2*a*, for example) within a corresponding receiving-type interconnect component (4*a*, for example) allows the transmission of electrical signals between each post 2 of the projection-type interconnect component and a corresponding one of the beams 4 from the receiving-type electrical interconnect component.

FIG. 3 is a side view of one of the conductive beams 4 depicted in FIG. 1. As seen from FIG. 3, each beam 4 includes a contact section 41, a stabilizing section 42, and a foot section The contact section 41 of each conductive beam 4 of each receiving-type interconnect component contacts a conductive post 2 of a corresponding projection-type interconnect component when the projection-type interconnect component is received within the receiving-type interconnect component. The contact section 41 includes three different segments: an interface section 41*a* connected to the stabilizing section 42; an elongated section 41*b* connected to the interface section 41*a*; and a lead-in section 41*c* connected to the elongated section 41*b*. The stabilizing section 42 is retained within the insulative substrate 3 to secure the beam 4 to the insulative substrate. The foot section 43 connects to an interface device (e.g., a printed circuit board) to allow the transmission of electrical signals, via the beam 4, between the interface device and the one of the posts with which the contact section 41 of the beam 4 is in contact after mating.

The beam 4 of FIG. 3 is a useful component of the electrical system depicted in FIG. 1. However, the inventors have discovered that the beam 4 has not yet been optimized to the extent that it could be.

In this regard, the inventors have discovered, for example, that the interface between the contact section 41 and the stabilizing section 42, indicated by a dotted line circle in FIG. 3, is subject to a great deal of stress when the contact section 41 of each beam 4 is deflected to accommodate a corresponding post. More particularly, because the contact section 41 is narrower than the stabilizing section 42, the interface between the contact section 41 and the stabilizing section 42 only extends approximately half or less than half way across the width of the stabilizing section, with the result that a majority of the stress caused by the deflecting of the contact section 41 is transferred to a relatively small area of the stabilizing section. Such a large concentration of stress within a relatively small area can cause the beam 4 to tend to break or crack at the interface between the contact section 41 and the stabilizing section 42 when the contact section of the beam is deflected.

Also, the inventors have discovered that the shape of the contact section 41 depicted in FIG. 3 may not be the optimum contact section shape. The fact that the contact section 41 is made up of straight segments, for example, tends to focus stress resulting from contact section deflection on the point where the contact section 41 and the stabilizing section 42 interface, which point, as discussed above, is not particularly resistant to stress. Moreover, because the contact section 41 is essentially straight, the contact section must be deflected outward to a significant degree in order to achieve a normal force (which is the force exerted by the contact section of the beam 4 on the post 2 in a direction normal to the surface of the post that is contacting the beam) that is high enough to maintain good electrical connection between the beam and the post. That the contact section 41 must be deflected outward to a significant degree to make good electrical contact between the post and beam can result in various disadvantages.

First of all, the further the contact section 41 must be deflected outward for the purpose of accommodating a corresponding post, the greater the distance required between adjacent contacts. In turn, the greater the distance between adjacent contacts, the lower the contact density of the electrical interconnect system.

Secondly, when the contact section 41 of the beam 4 is deflected outward to a significant degree, the beam can, in some cases, reach its "yield point." The yield point of a beam corresponds to the point of deflection at which the beam will not retain the normal-force-exerting properties that it had prior to deflection. A beam stretched at or beyond its yield point, for example, will not be able to exert the same normal force at a given degree of deflection that it did at that degree of deflection prior to being stretched to at or beyond its yield point. In essence, once a beam has been stretched to at or beyond its yield point, it will not be as resilient as it was prior to reaching the yield point. When a beam has been stretched to at or beyond its yield point, such that it loses its original stiffness and resiliency, it is said to have "taken a set." It is desirable to have a beam that does not easily reach its yield point or take a set.

The inventors have also discovered that the shape of the lead-in section 41*c* of the contact section 41 of the beam 4 depicted in FIG. 3 could be further optimized. In this regard, it is the lead-in section 41*c* that protrudes out the furthest as a result of the contact section 41 being deflected for the purpose of mating a projection-type interconnect component with a receiving-type interconnect component. The width of the lead-in section 41*c* is somewhat substantial and, consequently, the lead-in section 41*c* tends to protrude to a significant extent in the direction of other contacts of the electrical interconnect system. Excessive protrusion of the relatively wide lead-in section 41*c* toward the other contacts of the electrical interconnect system will disadvantageously reduce the overall contact density of the system.

In sum, the beam 4 depicted in FIG. 3, while providing significant advantages over prior art contacts known to the inventors, could stand further optimization. More particularly, if the configuration of portions of the beam 4, such as the stabilizing section 42 and the contact section 41 (including the interface, stabilizing, and lead-in sections 41*a*, 41*b*, and 41*c*), were refined to overcome the disadvantages discussed above, an electrical interconnect system that is more reliable and higher in density could be achieved.

SUMMARY OF THE INVENTION

Accordingly, the present invention is directed to an electrically conductive contact beam, for use in an electrical interconnect system, that substantially obviates one or more of the problems due to limitations and disadvantages of the related technology.

It is a goal of the present invention to provide a contact beam with physical features that provide improved contact force, elasticity, and reliability.

Another goal of the present invention is to provide a contact beam that is highly resistant to stress at the point where the contact and stabilizing sections of the beam interface.

Yet another goal of the present invention is to provide a contact beam having a stabilizing section that is significantly wider than a flexible portion of the contact section to ensure that the flexible portion will bend or flex when a force is applied to the contact section.

Still another goal of the present invention is to provide a contact beam having a merge radius at the point where the stabilizing section joins the flexible portion of the contact section. This serves to distribute the stress caused by the deflecting contact section throughout the base of the stabilizing section, rather than transferring all of the stress to only half or less than half of the stabilizing section.

A further goal of the present invention is to provide a contact beam including a contact section having a flexible portion formed with a slight curvature. This gives the contact beam more compliance and once again serves to distribute stress better throughout the beam structure. The flexible portion can be the same thickness along its length or may taper towards a contact area of the flexible portion. Beams that taper are generally more compliant.

Yet another goal of the present invention is to provide a contact beam having a lead-in section that is narrower than its stabilizing section and the flexible portion of its contact section. This allows the beam to be inserted into the insulative substrate lead-in section first. Since the lead-in section is the section of the beam that deflects the most once it makes contact, making the lead-in section smaller allows other contacts to be placed closer together, thereby providing an electrical interconnect system having a higher contact density.

Additional features and advantages of the invention will be set forth in the description which follows, and in part will be apparent from the description, or may be learned by practice of the invention. The objectives and advantages of the invention will be realized and attained by the apparatus particularly pointed out in the written description and claims hereof as well as the appended drawings.

To achieve these and other advantages and in accordance with the purpose of the invention, as embodied and broadly described, the invention comprises an electrically conductive contact beam for use in an electrical interconnect component, the contact beam comprising a stabilizing section for securing the contact beam within a support substrate, a contact section, connected to the stabilizing section, for establishing contact between the contact beam and an electrically conductive contact from another electrical interconnect component, the contact section including a merge radius section connecting the contact section to the stabilizing section, a flexible section, connected to the merge radius section and having an elongated curvature, a contact area, disposed at an end of the curvature opposite the merge radius section, for contacting the conductive contact from the other electrical interconnect component, and a lead-in section, connected to the contact area, for initiating deflection of the contact section upon contact of the lead-in section with a portion of the other electrical interconnect component.

It is to be understood that both the foregoing general description and the following detailed description are exemplary and explanatory and are intended to provide further explanation of the invention as claimed. The accompanying drawings are included to provide a further understanding of the invention and are incorporated in and constitute a part of this specification, illustrate several embodiments of the invention, and together with the description, serve to explain the principles of the invention.

DETAILED DESCRIPTION OF THE PREFERRED EMBODIMENTS

Figure 1:
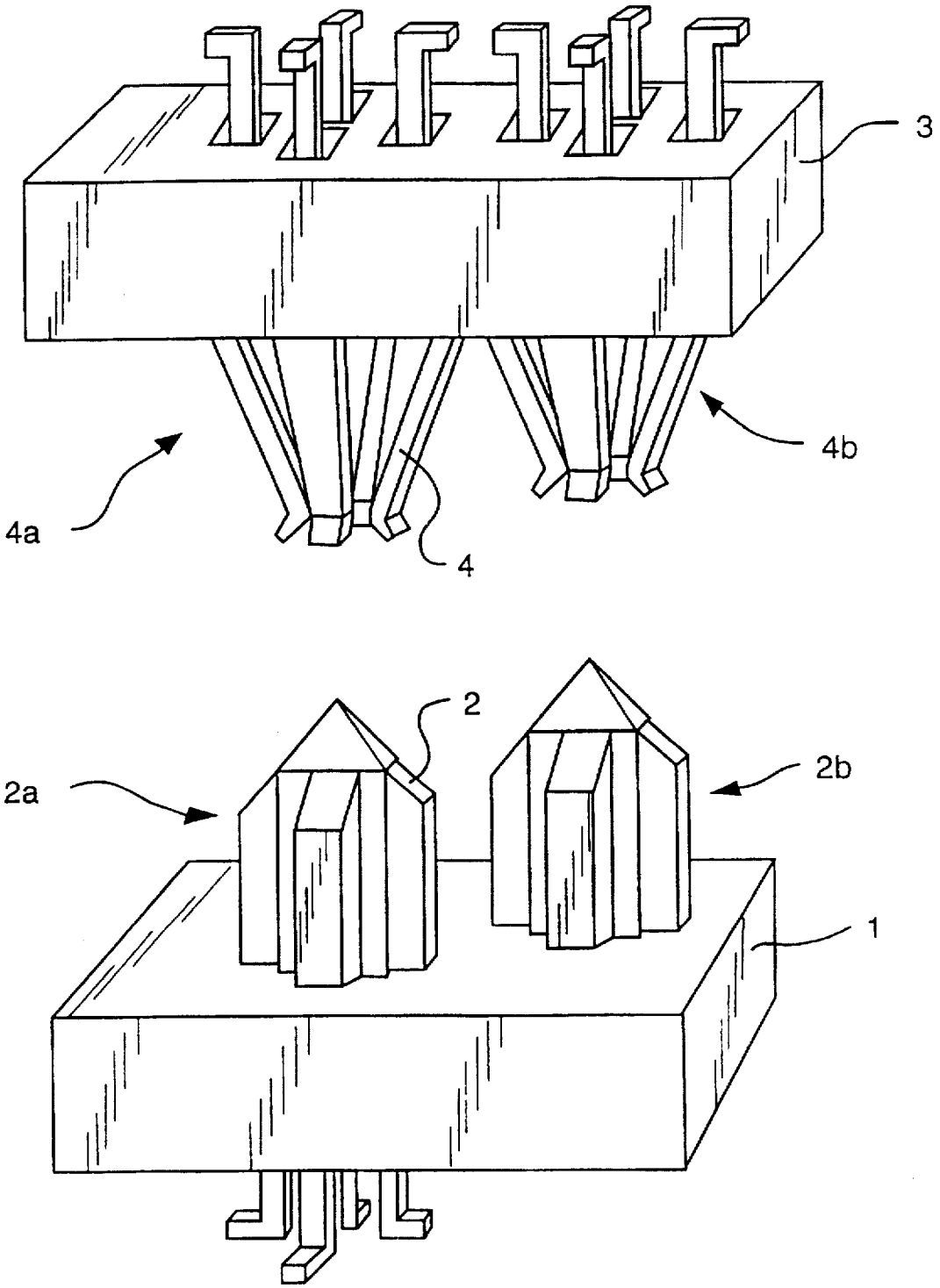
FIG. 1 is a perspective view of projection-type electrical interconnect components just prior to mating with receiving-type electrical interconnect components.
Figure 2:
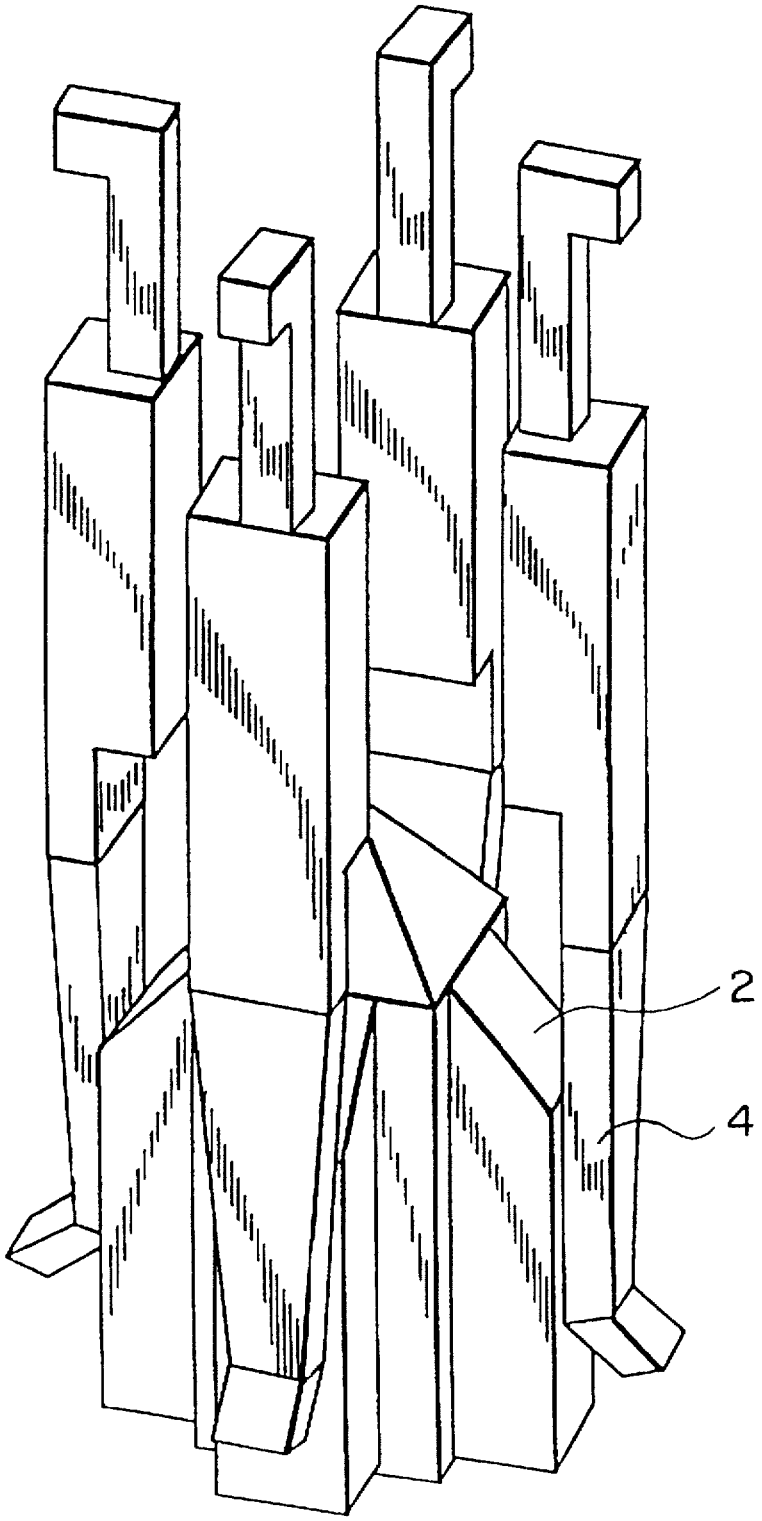
FIG. 2 is a perspective view of projection-type and receiving-type electrical interconnect components from FIG. 1, with the components shown in their mated condition.

Reference will now be made in detail to the present preferred embodiments of the invention, examples of which are illustrated in the accompanying drawings. The same reference numerals will be used to designate the same components throughout the various drawings.

Figure 4:
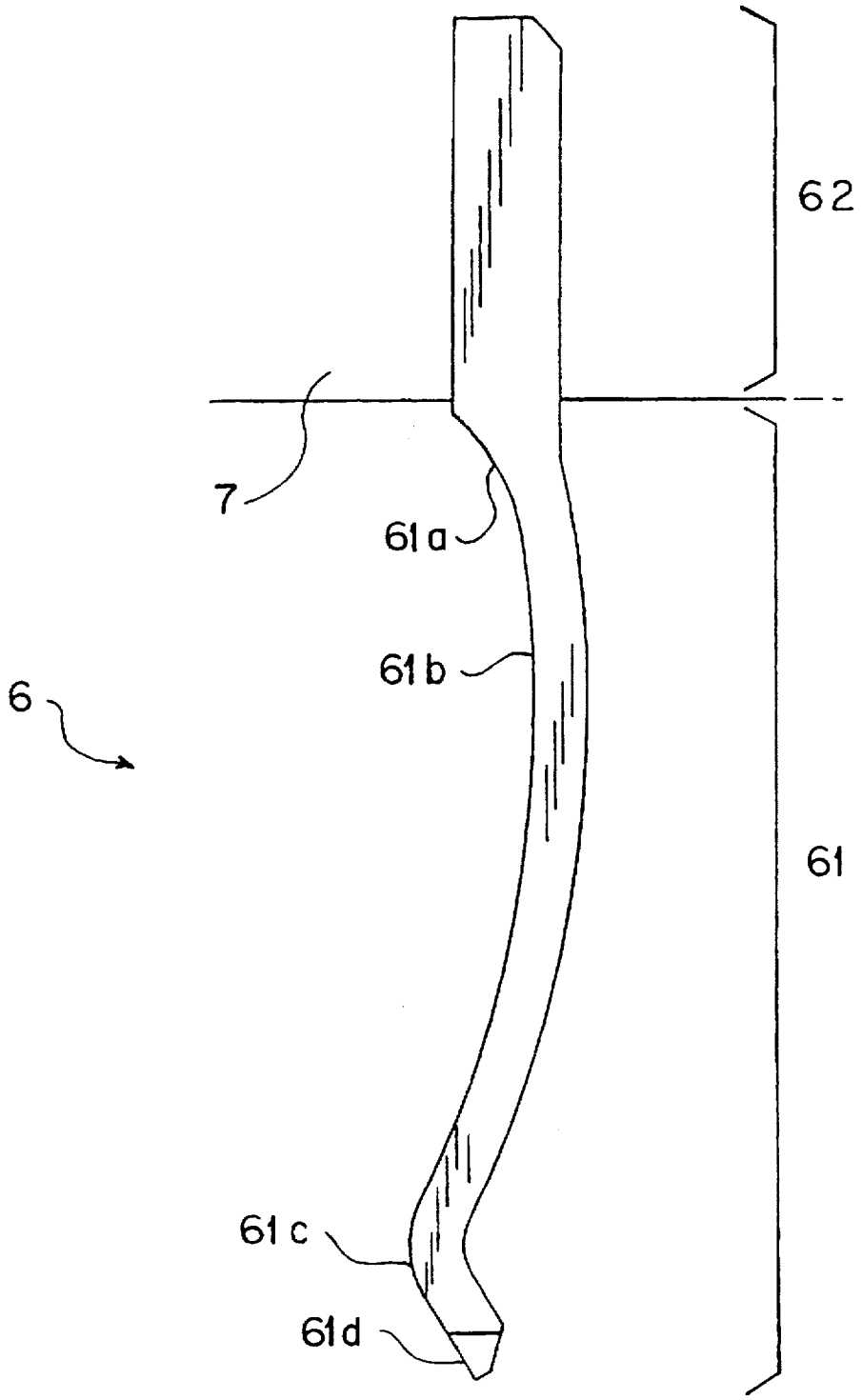
FIG. 4 is a side view of a conductive contact beam in accordance with the present invention.

The present invention is a flexible electrical (e.g., electronic) contact beam intended for use in an electrical connector such as a receiving-type electrical interconnect component. An exemplary embodiment of the contact beam of the present invention is shown in FIG. 4 and is designated generally by reference numeral 6. As embodied herein and referring to FIG. 4, the contact beam 6 includes a contact section 61, a stabilizing section 62, and a foot section (not shown in FIG. 4) that provides interface to a printed circuit board, a cable, or the like.

The contact section 61 of each conductive beam 6 corresponds to the portion of the contact beam extending from one side of an insulative substrate 7. The contact section 61 of each conductive beam 6 contacts a conductive contact from another electrical connector to allow the transmission of electrical signals between the contact beam 6 and that electrical connector. For example, the contact beam 6 could be one of a plurality of contact beams in a receiving-type electrical interconnect component that contacts a conductive post of a corresponding projection-type interconnect component when the projection-type interconnect component is received within the corresponding receiving-type interconnect component. The contact section 61 includes a merge radius 61*a*, a flexible section 61*b*, a contact area 61*c*, and a lead-in section 61*d*.

The stabilizing section 62 is that section of the beam 6 which is retained within the insulative substrate 7. The stabilizing section secures the beam 6 to the insulative substrate 7 and prevents the beam from twisting or being dislodged during handling, mating, and manufacturing. The stabilizing section 62 is of a dimension that locks the beam into the substrate 7 while allowing an adequate portion of the substrate to exist between adjacent conductive beams. One end of the stabilizing section 62 is connected to the contact section 61 (as shown in FIG. 4), while the other end of the stabilizing section is connected to the foot section (not shown in FIG. 4).

The foot section (not shown in FIG. 4) of the contact beam 6 corresponds to the portion of the contact beam extending from the side of the insulative substrate 7 opposite that from which the contact section 61 extends. The foot section connects to an interface device, (e.g., a semiconductor chip, a printed circuit board, a wire or a round, flat, or flex cable) to allow the transmission of electrical signals, via the beam 6, between the interface device and the contact (e.g., a post) with which the contact section 61 of the beam is in contact after mating.

The stabilizing section 62 is significantly wider than (e.g., at least double the width of) the flexible section 61*b*. This ensures that the flexible section 61*b* will bend or flex when force is applied to the contact area 61*c*. Where the stabilizing section 62 joins the flexible section 61*b*, there is a merge radius 61*a*. The merge radius 61*a* corresponds to the point of the beam 6 at which the portion of the contact beam 61 connected to the stabilizing section 62 and the flexible section 61*b* come together or gradually blend into one another without abrupt change. The merge radius 61*a* serves to distribute the stress caused by the deflection of contact section 61 throughout the base of the stabilizing section 62 rather than transferring all the stress to only a portion (e.g., half) of the stabilizing section. This prevents the beam 6 from cracking or breaking.

The flexible section 61*b* of the contact section 61 is formed with a slight curvature. This gives the beam 6 more compliance and helps to distribute stress better throughout the beam structure. An additional advantage resulting from the curvature of flexible section 61*b* is the provision of minimum spacing between contacts. In this regard, because the contact section is curved (at the flexible section 61*b*, for example) rather than straight, less displacement is required to achieve an adequate normal force. Less displacement, in turn, means a decrease in the chance that the beam 6 will be overstressed.

Figure 3:
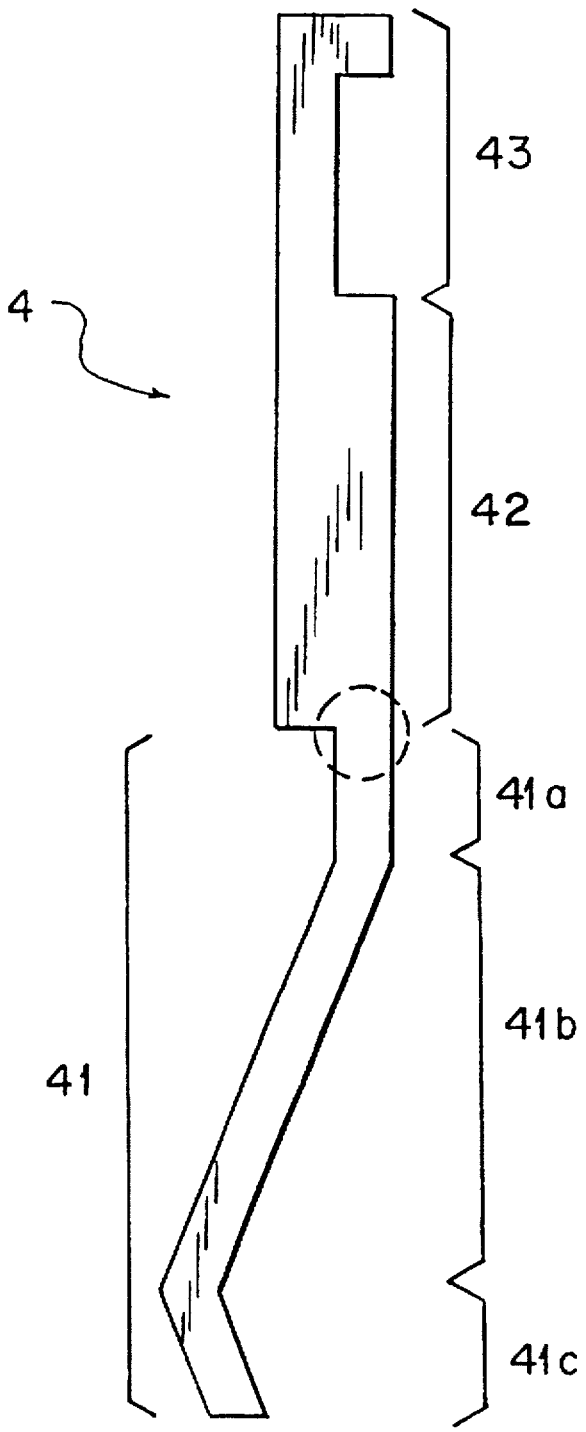
FIG. 3 is a side view of one of the contact beams depicted in FIG. 1.

An important aspect of the present invention is that the contact beam 6 of FIG. 4 can provide approximately the same normal force as that provided by the contact beam depicted in FIG. 3, without approaching the yield point. As a result of the contact beam 6 of FIG. 4 having a higher yield point, the contact beam 6 retains a better deflection memory and is therefore much more reliable. The improved reliability resulting from the beam configuration of FIG. 4 is especially important when the invention is used in vibratory environments or other environments in which the beam yield point is likely to be approached.

Another result of the contact beam 6 of FIG. 4 having a high yield point, is that the contact beam 6 is less likely to ever take a set. This improves reliability in situations where the electrical interconnect component incorporating the beam 6 is plugged into connection with connectors having different tolerances. If the electrical interconnect component is plugged into a connector of a larger dimension and then into a connector of a smaller dimension, for example, the difference between the larger and smaller dimensions will be compensated for due to the curvature of the beam 6.

Figure 5:
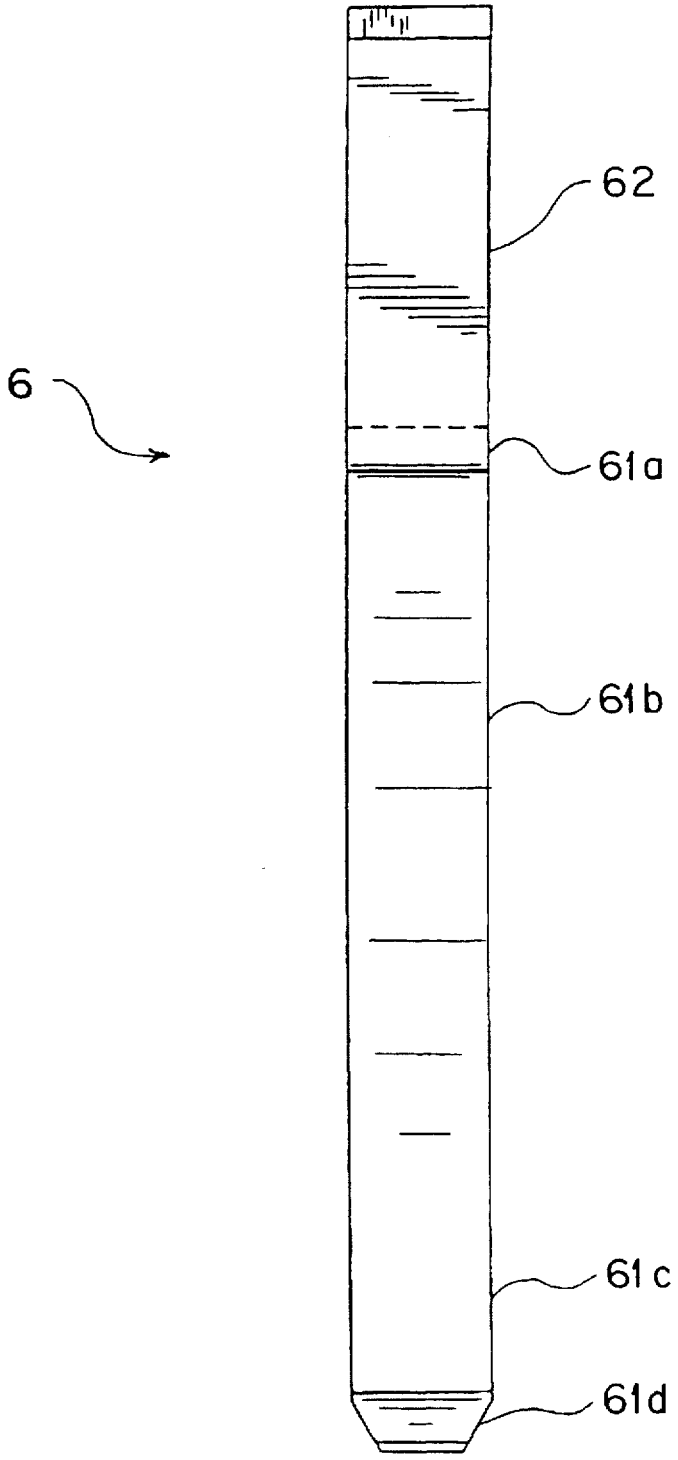
FIG. 5 is a front view of the contact beam of the present invention having the same thickness along its length.
Figure 6:
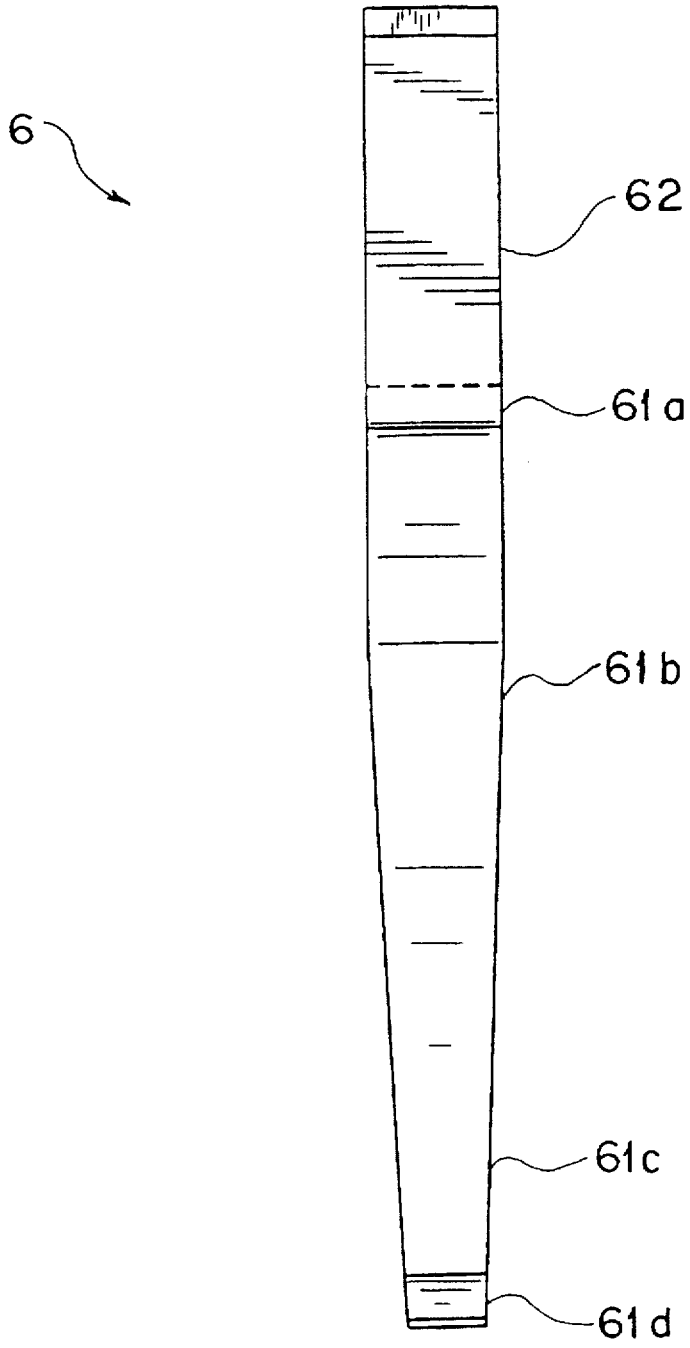
FIG. 6 is a front view of the contact beam of the present invention that is tapered toward its contact area.

The flexible section 61*b* can be the same thickness along its length, as shown in FIG. 5, or may taper toward the contact area 61*d*, as shown in FIG. 6. Beams that taper are generally more compliant.

Figure 7:
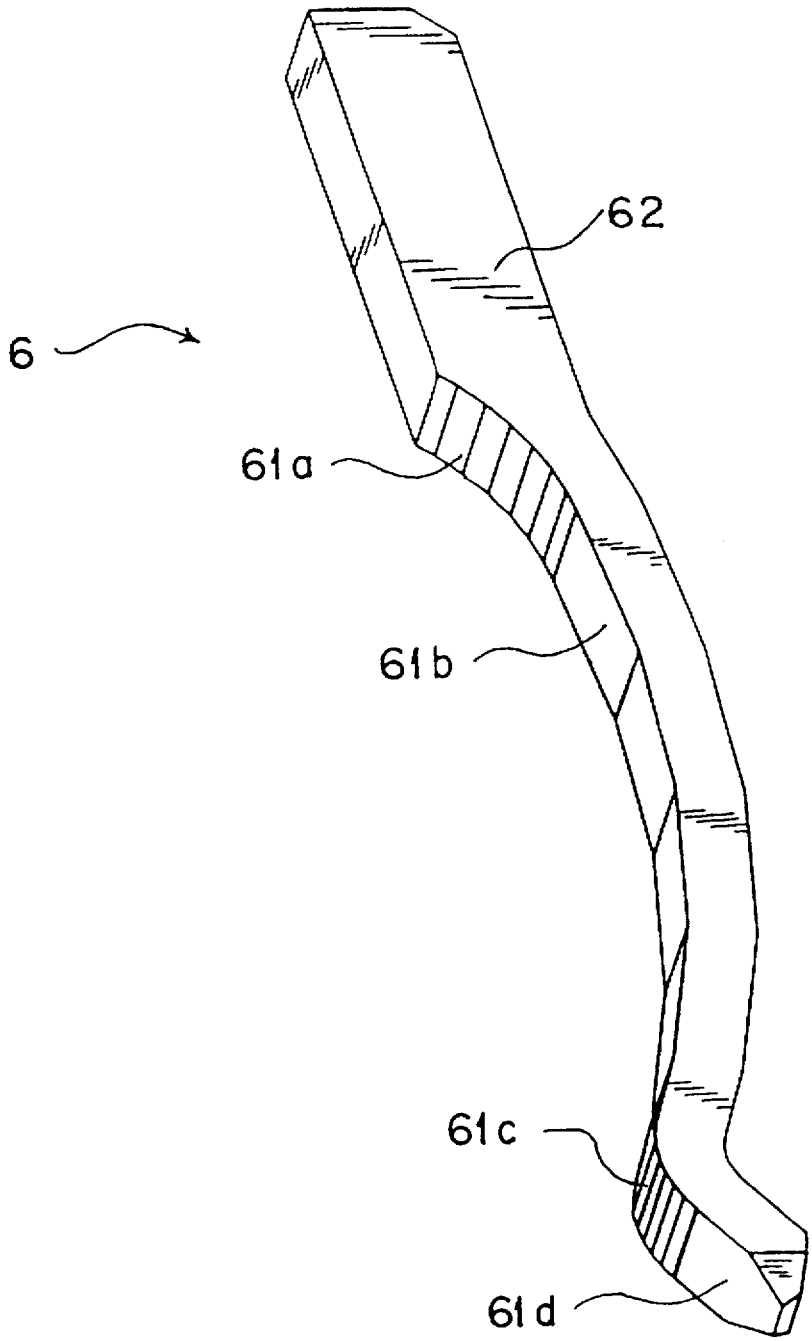
FIGS. 7, 8, and 9 are different perspective views of the conductive contact beam of the present invention depicted in FIG. 4.
Figure 8:
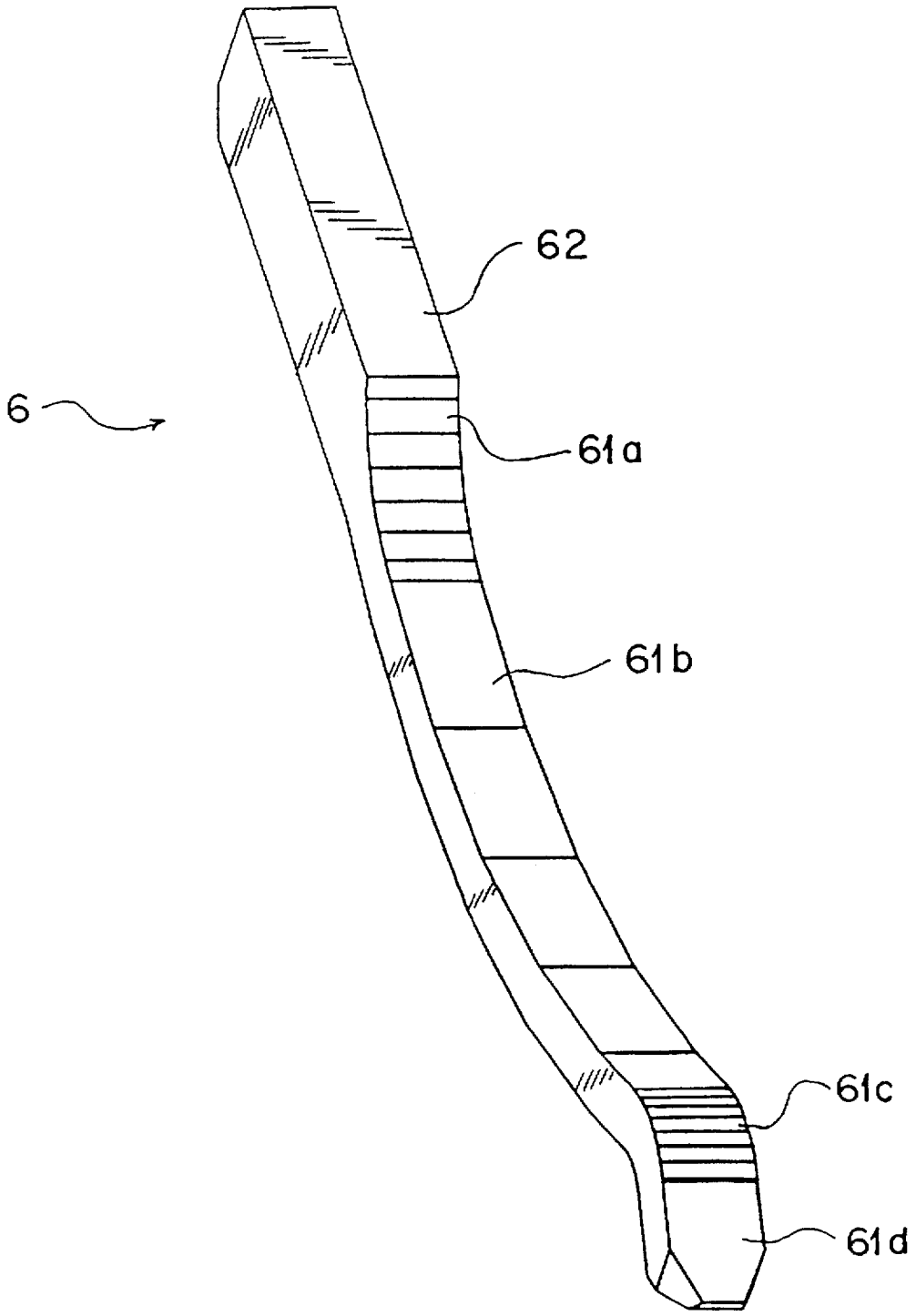
Figure 9:
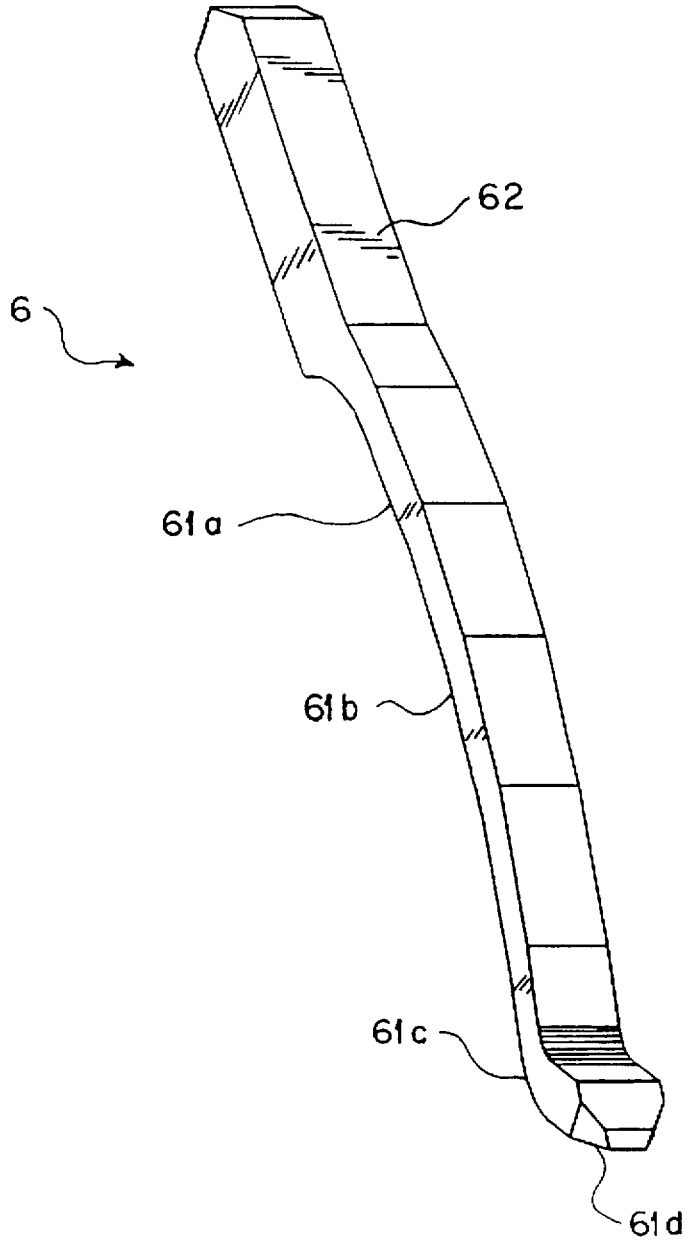

As seen most clearly in FIGS. 7, 8, and 9, the lead-in section 61*d* is preferably narrower than the flexible section 61*b* and the stabilizing section 62. This allows the beam 6 to be inserted into the insulative substrate 7 lead-in section 61*d* first. Since the lead-in section 61*d* is the section of the beam that deflects the most once it makes contact, making this section smaller allows other contacts to be placed closer together, thereby increasing the overall contact density of the electrical interconnect system.

Having discussed the features of the beam 6 of the present invention, this description now turns to a discussion on the incorporation of the beam 6 into a receiving-type electrical interconnect component. In this regard, each receiving-type electrical interconnect component of the present invention includes several of the electrically conductive beams 6 attached to an insulative substrate. Each receiving-type electrical interconnect component is configured to receive a corresponding projection-type electrical interconnect component within a space between the conductive beams. More particularly, the contact sections of the contact beams 6 deflect away from each other to receive a corresponding projection-type electrical interconnect component within the space between the conductive beams. The substrate insulates the conductive beams from one another so that a different electrical signal may be transmitted on each beam. Preferably, the material of the substrate is an insulative material that does not shrink when molded (for example, a liquid crystal polymer such as VECTRA, which is a trademark of Hoechst Celanese).

Each contact beam 6 of each receiving-type electrical interconnect component can be made of any electrically conductive material with adequate elastic properties. For example, each beam 6 can be made of metal, such as beryllium copper, phosphor bronze, brass, or a copper alloy. Preferably, each beam 6 is plated with tin, gold, palladium, or nickel at the portion of the beam (e.g., contact area 61*c*) which will contact a conductive post of a corresponding projection-type electrical interconnect component when the projection-type electrical interconnect component is received within the receiving-type electrical interconnect component.

As discussed above with reference to FIG. 4, the contact section 61 of each contact beam 6 contacts a conductive post of a corresponding projection-type electrical interconnect component when the projection-type electrical interconnect component is received within the receiving-type electrical interconnect component. The contact area 61*c* is the portion of the contact section 61 which contacts a conductive post when the projection-type and receiving-type electrical interconnect components are mated. This is in contrast to the beam 4 of FIG. 3, wherein essentially the whole length of the contact section 41 contacts the conductive post when the electrical interconnect components are mated. As compared to the beam 4 of FIG. 3, the beam 6 of FIG. 4 has less surface area in contact with its corresponding post during mating but, perhaps more importantly, has an increased normal force due to the curvature of flexible section 61*b*. The lead-in section 61*d* of beam 6 comprises a sloped surface which initiates separation of the contact beams during mating upon coming into contact with the tip portion of the buttress of the projection-type electrical interconnect component (or, when a buttress is not used, upon coming into contact with one or more posts of the projection-type electrical interconnect component).

The stabilizing section 62, in addition to securing the beam 6 within an insulative substrate, connects the contact section 61 to the foot section. The foot section, in turn, connects to an interface device (e.g., a semiconductor chip, a printed circuit board, a wire, or a round, flat, or flex cable) which uses the electrical interconnect system as an interface. The configuration of the foot section depends on the type of device with which it is interfacing.

The projection-type electrical interconnect component that may be used with the present invention includes several electrically conductive posts attached to an electrically insulative substrate. The projection-type electrical interconnect component may also include an electrically insulative buttress around which the conductive posts are positioned, although use of an insulative buttress is optional.

The substrate and the buttress insulate the conductive posts from one another so that a different electrical signal may be transmitted on each post. Components 2*a* and 2*b* of FIG. 1 are representative of examples of the type of projection-type interconnect components which may be used in connection with the beams of the receiving-type interconnect components of the present invention.

The projection-type electrical interconnect components shown in the drawings (FIG. 1, for example) are exemplary of the type of electrical interconnect components that can be used in the electrical interconnect system of the present invention. Other projection-type electrical interconnect components are contemplated.

Figure 10:
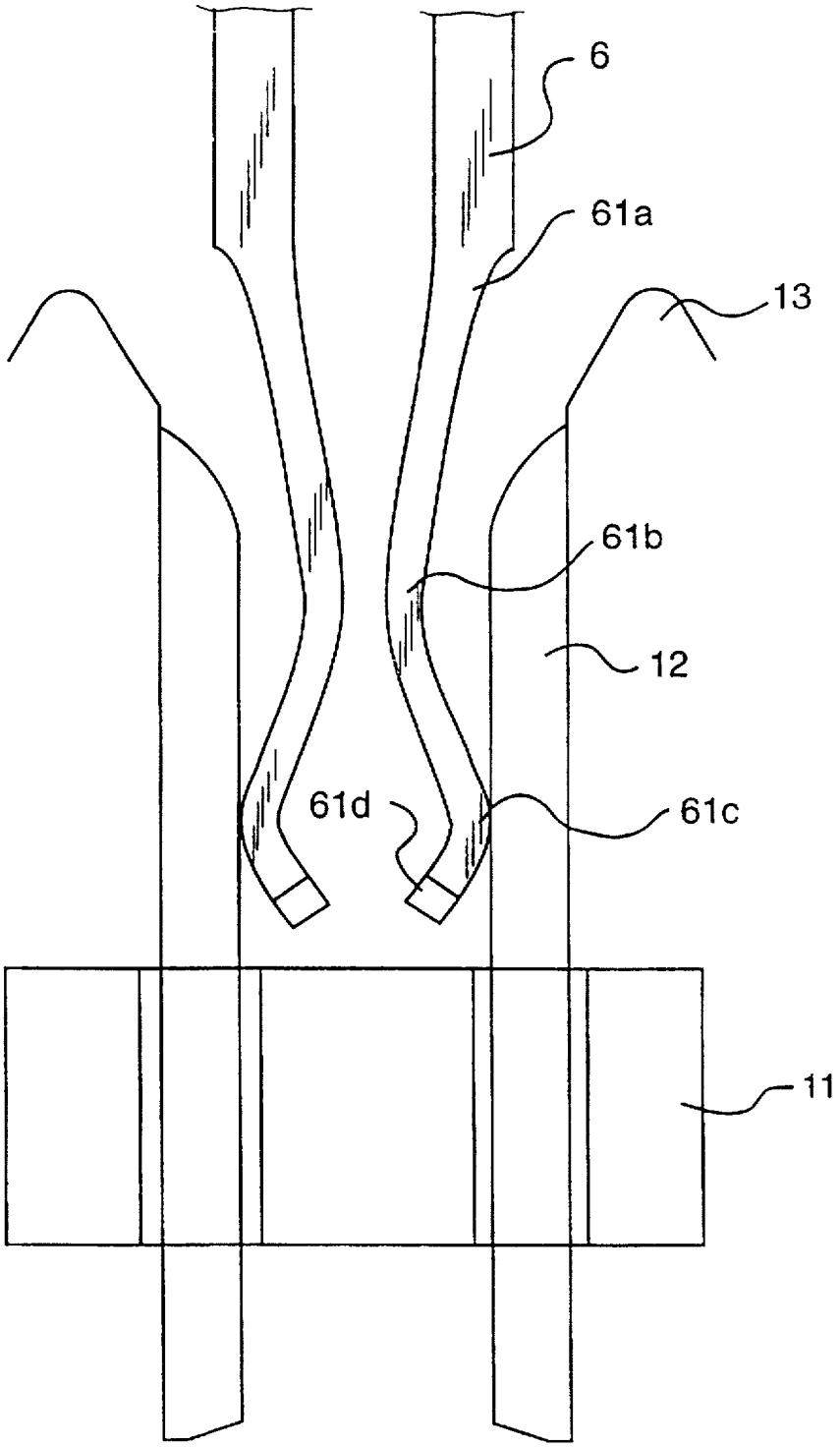
FIG. 10 is a side view of a pair of adjacent projection-type electrical interconnect components and contact beams of different receiving-type electrical interconnect components disposed in contact with the conductive posts of the projection-type electrical interconnect components.

FIG. 10 shows a pair of beams 6 from different receiving-type electrical interconnect components, each of the beams contacting a conductive post 12 from a corresponding projection-type electrical interconnect component including an insulative buttress. It should be noted that the inclusion of a buttress 13 within each projection-type interconnect component shown in the drawings is optional.

As can be seen from FIG. 10, due to the unique configuration of each of the beams 6, the contact section need not be deflected outward to a significant degree to make good electrical contact between each post 12 and its corresponding beam 6. This allows the conductive contacts to be placed closer together, resulting in a higher contact density, and reduces the chances of the beams reaching their yield point. Contact density could be further enhanced using a beam 6 having a narrow lead-in section 61*d*, such as that depicted in FIG. 4, or by ensuring that the lead-in section 61*d* of facing contact beams, such as the beams 6 of FIG. 10, are at different heights.

The spreading of the contact beams 6 during mating performs a wiping function to wipe away debris and other contaminants that may be present on the surfaces of the posts 12, the buttress 13 (if used), and the beams 6. Such wiping allows for more reliable electrical interconnection and the provision of a greater contact area between mated conductive elements.

The conductive posts and conductive beams of the electrical interconnect components may be stamped from strips or from drawn wire, and are designed to ensure that the contact and interface sections face in the proper direction in accordance with the description of the posts and beams above. Both methods allow for selective plating and automated insertion.

The stamped contacts can be either loose or on a strip since the asymmetrical shape lends itself to consistent orientation in automated assembly equipment. Strips can either be between stabilizing areas, at the tips, or as part of a bandolier which retains individual contacts. The different length tails on the right-angle versions assist with orientation and vibratory bowl feeding during automated assembly.

The present invention is compatible with both stitching and gang insertion assembly equipment. The insulative connector bodies and packing have been designed to facilitate automatic and robotic insertion onto printed circuit boards or in termination of wire to connector. As an alternative to forming an insulative substrate and then inserting the contacts into the substrate, the insulative substrate may be formed around the contacts in an insert molding process. The completed parts are compatible with PCB assembly processes.

The contact beams 6 of the present invention (FIG. 4, for example) can be used in any of the receiving-type electrical interconnect components discussed above for mating with any of the projection-type electrical interconnect components discussed above. Moreover, the beams 6 of the present invention can be used in receiving-type electrical interconnect components and with projection-type electrical interconnect components such as those discussed in a U.S. patent application Ser. No. 5,575,688, and U.S. Pat. application Ser. No. 5,641,309, the former being a continuation of and the latter being a continuation-in-part of U.S. patent application Ser. No. 07/983,083 to Stanford W. Crane, Jr. filed on Dec. 1, 1992 now abandoned. Each of these applications is entitled "High-Density Electrical Interconnect System." In essence, the contact beams 6 of the present invention can be used in place of any contact beam discussed in the aforementioned applications, to achieve the same or similar objects, and the contact beams 6 of the present invention can be manufactured and used in accordance with the manufacturing and usage of the contact beams described in the aforementioned applications. The present application expressly incorporates the aforementioned patent applications by reference.

It will be apparent to those skilled in the art that various modifications and variations can be made in the apparatus and methods of the present invention without departing from the spirit or scope of the invention. Thus, it is intended that the present invention cover the modifications and variations of this invention provided they come within the scope of the appended claims and their equivalents.

What is claimed is:

1. An electrically conductive contact beam for use in an electrical interconnect component, the contact beam comprising:

a stabilizing section for securing the contact beam within a supporting substrate;

a contact section for establishing contact between the contact beam and an electrically conductive contact from another electrical interconnect component, said contact section having a first side and a second side opposite to the first side, said contact section comprising:

a flexible section projecting from the stabilizing section and having an elongated concave curvature on the first side of the contact section extending substantially the entire length of the flexible section;

a contact area disposed at an end of the flexible section opposite the stabilizing section and having a contact surface on the first side of the contact section; and a lead-in section, connected to the contact area, for initiating deflection of the contact section upon contact of the lead-in section with a portion of the other electrical interconnect component, wherein the stabilizing section is substantially wider than the flexible section wherein the contact section further comprises a merge radius section intermediate the stabilizing section and the flexible section.

2. The electrically conductive contact beam of claim 1, wherein the stabilizing section has a width where the stabilizing section connects to the contact section, and the merge radius section comprises means for distributing stress caused by deflection of the contact section throughout the width of the stabilizing section.

3. The electrically conductive contact beam of claim 1, wherein the stabilizing section has a width which is at least double that of the flexible section.

4. The electrically conductive contact beam of claim 1, wherein the elongated concave curvature of the contact section of the beam comprises means for distributing stress caused by deflection of the contact section throughout the contact beam.

5. The electrically conductive contact beam of claim 1, wherein the contact area of the contact section comprises means for applying a normal force against the conductive contact of the other electrically interconnect component.

6. The electrically conductive contact beam of claim 1, wherein the flexible section has uniform thickness along its length.

7. The electrically conductive contact beam of claim 1, wherein the flexible section has a thickness that tapers towards the contact area.

8. The electrically conductive contact beam of claim 1, wherein the lead-in section is narrower than the stabilizing section.

9. The electrically conductive contact beam of claim 8, wherein the lead-in section is narrower than the stabilizing section and the flexible section.

10. An electrical interconnect component comprising:

a supporting substrate; and at least one electrically conductive contact beam, the contact beam comprising:

a stabilizing section for securing the contact beam within the supporting substrate;

a contact section for establishing contact between the contact beam and an electrically conductive contact from another electrical interconnect component, said contact section having a first side and a second side opposite to the first side, said contact section comprising:

a flexible section projecting from the stabilizing section and having an elongated concave curvature on the first side of the contact section extending substantially the entire length of the flexible section;

a contact area disposed at an end of the flexible section opposite the stabilizing section and having a contact surface on the first side of the contact section; and a lead-in section, connected to the contact area, for initiating deflection of the contact section upon contact of the lead-in section with a portion of the other electrical interconnect component, wherein the stabilizing section is substantially wider than the flexible section wherein the contact section further comprises a merge radius section intermediate the stabilizing section and the flexible section.

11. The electrical interconnect component of claim 10, wherein the stabilizing section has a width where the stabilizing section connects to the contact section, and the merge radius section comprises means for distributing stress caused by deflection of the contact section throughout the width of the stabilizing section.

12. The electrical interconnect component of claim 10, wherein the stabilizing section has a width which is at least double that of the flexible section.

13. The electrical interconnect component of claim 10, wherein the elongated concave curvature of the contact section of the beam comprises means for distributing stress caused by deflection of the contact section throughout the contact beam.

14. The electrical interconnect component of claim 10, wherein the contact area of the contact section comprises means for applying a normal force against the conductive contact of the other electrically interconnect component.

15. The electrical interconnect component of claim 10, wherein the flexible section has uniform thickness along its length.

16. The electrical interconnect component of claim 10, wherein the flexible section has a thickness that tapers towards the contact area.

17. The electrical interconnect component of claim 10, wherein the lead-in section is narrower than the stabilizing section.

18. The electrical interconnect component of claim 17, wherein the lead-in section is narrower than the stabilizing section and the flexible section.

19. The electrical interconnect component of claim 10, wherein the supporting substrate is an insulative substrate.

20. The electrical interconnect component of claim 10, wherein the stabilizing section is secured completely within the supporting substrate, and the contact section extends out completely from the supporting substrate.

* * * * *